US007410288B1

(12) United States Patent
Kelso et al.

(10) Patent No.: US 7,410,288 B1
(45) Date of Patent: Aug. 12, 2008

(54) FLUID MIXING DEVICE

(75) Inventors: Richard Malcolm Kelso, South Australia (AU); Peter Vernon Lanspeary, South Australia (AU); Graham J. Nathan, South Australia (AU); Steven J. Hill, South Australia (AU); Jordan James Parham, South Australia (AU); Graham Kelly, South Australia (AU); Philip Robert Edward Cutler, South Australia (AU); Moohd Ghazali Budrulhisham, South Australia (AU)

(73) Assignee: Luminis Pty. Ltd., Adelaide (AU)

( * ) Notice: Subject to any disclaimer, the term of this patent is extended or adjusted under 35 U.S.C. 154(b) by 365 days.

(21) Appl. No.: 09/857,204

(22) PCT Filed: Dec. 24, 1999

(86) PCT No.: PCT/AU99/01164

§ 371 (c)(1),
(2), (4) Date: Sep. 18, 2001

(87) PCT Pub. No.: WO00/39504

PCT Pub. Date: Jul. 6, 2000

(30) Foreign Application Priority Data

Dec. 24, 1998 (AU) ..... PP7936/98

(51) Int. Cl.
*F23C 7/00* (2006.01)

(52) U.S. Cl. ..... 366/341; 366/174.1; 48/180.1; 48/189.3; 431/350; 431/353

(58) Field of Classification Search ..... 366/174.1, 366/175, 3, 336–341, 169.1, 169.2, 165.1, 366/167.2; 431/115, 116, 171, 172, 200, 431/238, 350–355; 48/180.1, 189.3
See application file for complete search history.

(56) References Cited

U.S. PATENT DOCUMENTS 384,068 A * 6/1888 Patterson et al.

(Continued)

FOREIGN PATENT DOCUMENTS

AU 28889/77 3/1979

(Continued)

OTHER PUBLICATIONS

Fishbane et al., Physics for Scientists and Engineers, 1993, Prentice-Hall, Inc., p. 504.*

(Continued)

*Primary Examiner*—David L Sorkin
(74) *Attorney, Agent, or Firm*—Greenblum & Bernstein, P.L.C.

(57) ABSTRACT

A fluid mixing device (1) includes a chamber (3) and a bluff body (4) defining one end of the chamber (3). A first fluid inlet (5) is located toward an opposite end of the chamber (3) from the bluff body (4) and arranged to direct fluid toward the bluff body (4). A region substantially surrounding the bluff body (4) has a flow divider (8) defining second fluid inlet(s) (11) to the chamber (3) and mixed fluid outlets (12) from the chamber (3). A fluid flow from the first fluid inlet (5) and/or from the second fluid inlet (11) establishes a recirculating vortex system (14) within the chamber and results in a mixture of fluids from the first fluid inlet (5) and the second fluid inlet(s) (11) being directed through the mixed fluid outlets (12).

15 Claims, 12 Drawing Sheets

U.S. PATENT DOCUMENTS

| | | | | | |
|---|---|---|---|---|---|
| 879,735 | A | * | 2/1908 | Chamberlain | |
| 1,374,045 | A | * | 4/1921 | Vezie | |
| 1,862,051 | A | * | 6/1932 | Dufault | |
| 1,912,243 | A | * | 5/1933 | Andrews | 431/1 |
| 1,971,554 | A | * | 8/1934 | Forster | |
| 2,044,511 | A | * | 6/1936 | Ryschkewitsch | |
| 2,048,321 | A | * | 7/1936 | Carruthers et al. | |
| 2,558,238 | A | * | 6/1951 | Collins | |
| 2,601,000 | A | * | 6/1952 | Nerad | 60/758 |
| 2,920,445 | A | * | 1/1960 | Bailey | 60/262 |
| 2,925,858 | A | * | 2/1960 | Reed | |
| 2,930,192 | A | * | 3/1960 | Johnson | 60/746 |
| 2,974,485 | A | * | 3/1961 | Schiefer | 60/756 |
| 3,219,483 | A | | 11/1965 | Goos et al. | |
| 3,319,692 | A | * | 5/1967 | Reba et al. | |
| 3,749,548 | A | | 7/1973 | Zink et al. | |
| 4,021,188 | A | * | 5/1977 | Yamagishi et al. | |
| 4,199,935 | A | * | 4/1980 | Hakluytt | 60/734 |
| 4,416,613 | A | * | 11/1983 | Barisoff | |
| 4,845,940 | A | * | 7/1989 | Beer | 60/732 |
| 5,769,624 | A | | 6/1998 | Luxton et al. | |
| 6,685,102 | B1 | | 2/2004 | Mi et al. | |

FOREIGN PATENT DOCUMENTS

| | | |
|---|---|---|
| AU | 88999/82 | 4/1983 |
| AU | 29917/92 | 6/1993 |
| DE | 3902025 | 7/1989 |
| EP | 0849530 | 6/1998 |
| WO | 94/07086 | 3/1994 |
| WO | 95/32395 | 11/1995 |
| WO | 96/27761 | 9/1996 |
| WO | 99/26021 | 5/1999 |

OTHER PUBLICATIONS

Glossary form nas.nasa.gov.*
English Language Abstract of DE 3902025.

* cited by examiner

FLUID MIXING DEVICE

FIELD OF THE INVENTION

This invention relates to fluid mixing devices and in particular to such devices which mix one fluid with another fluid that may be flowing with widely variable direction and speed. In the following description the invention will primarily be described with reference to burner applications in which a combustible fluid (or fuel) is mixed with air to produce a flammable mixture. The invention is however not limited to this application and can be used in a wide variety of fluid mixing devices particularly where one of the fluids is flowing and a second fluid is required to be mixed with the flowing fluid in a relatively stable manner.

BACKGROUND ART

Numerous applications exist in which a burner is required to provide a stable flame while being subjected to winds or draughts of widely variable direction and speed, and under highly turbulent, or gusting conditions. Examples include flares, camping stoves, ceremonial torches and pilot burners in boilers and other industrial applications.

Flame stability is commonly achieved by the generation of a flow recirculation or a vortex flow pattern, either in the wake of a bluff-body or within the "vortex breakdown" associated with strongly swirling flows. While such flame holders are very successful in the relatively well defined conditions that occur within industrial combustion systems, they usually require that the combustion air be introduced through the burner in a carefully controlled manner in order to generate the necessary flow recirculation. The size, strength and stability of the recirculating flow is usually influenced by cross draughts in the furnace, or in the case of a flare, by the wind. To overcome the problem of sensitivity to the direction of the wind or cross-draught, the ideal aerodynamic flame holder should produce a recirculating flow pattern which is (1) independent of the direction of the wind or cross draught, and (2) insensitive to sudden changes in speed or to wind gusts.

A limiting factor in flame stability is the propagation speed of the flame front. Flame speed is a function of the fuel type and the air/fuel ratio and the turbulence. For most hydrocarbon fuels, the flame speed in a laminar flow (i.e. laminar flame speed) is typically less than 0.5 m/s. Although it is possible to produce stable flames in turbulent flows where the mean flow speed is an order of magnitude higher than the laminar flame speed, the actual local flame speed is still limited by the laminar flame speed. In contrast, instantaneous wind speeds in gusting conditions readily exceed 20 m/s and can reach speeds of 100 m/s or more. Hence a further purpose of a flame holder is to provide an aerodynamic "shield" which protects the flame (or at least the root of the flame) from high speed wind gusts. The aerodynamic shield provides a zone in which the flow speed is limited to the range of values necessary for good flame stability.

DISCLOSURE OF THE INVENTION

It is an object of this invention to provide a fluid mixing device for mixing one fluid with another fluid. In preferred configurations it is an object to produce mixing characteristics which are resistant to changes in cross-flow direction and speed.

In other preferred configurations it is an object to provide a burner that will provide a stable and continuous flame while being subjected to winds or draughts of widely variable direction and speed.

In one aspect this invention provides a fluid mixing device including a chamber, a bluff body defining one end of the chamber, a first fluid inlet disposed toward an opposite end of the chamber from said bluff body and arranged to direct fluid toward said bluff body, a region substantially surrounding said bluff body including a flow divider defining at least one second fluid inlet to said chamber and at least one mixed fluid outlet from said chamber, a fluid flow from said first fluid inlet and/or from said second fluid inlet establishing a recirculating vortex system within said chamber and resulting in a mixture of fluids from said first fluid inlet and said second fluid inlet(s) being directed through said mixed fluid outlets.

The flow divider preferably defines a plurality of flow channels which form the second fluid inlets and mixed fluid outlets. The second fluid inlets and mixed fluid outlets can be configured in any one of a number of arrangements depending upon the application of the device. The succession of flow channels defined by the flow divider may function as alternate second fluid inlets and mixed fluid outlets. The inlets and outlets may be of similar or different dimensions, and can be separated radially or azimuthally.

In a preferred embodiment as a flame stabiliser the flow divider is advantageously of a crinkle shape or corrugated in cross section. It can in addition or alternatively be shaped to impart a swirl to the inflow and/or the outflow.

In one preferred form the flow divider is of corrugated triangular form so that the second fluid inlets and mixed fluid outlets are generally triangular in cross section. In this arrangement the second fluid inlets preferably have the apex of the triangular cross section closest to the bluff body and the mixed fluid outlets have the base of the triangular cross section closest to the bluff body. A preferred arrangement of the device is axially symmetric about an axis perpendicular to the bluff body. In this configuration the first fluid inlet is preferably substantially aligned with the axis of symmetry or multiple first fluid inlets are disposed in a generally symmetric manner around the axis of symmetry.

Generally, the first fluid inlet provides a first fluid that is to be mixed with a second fluid from the second fluid inlet or inlets. In applications where multiple first fluid inlets are provided some of these may also be used to deliver one or more additional fluids into the chamber.

In one application of the fluid mixing device it is used as a burner. In one preferred form, at least some of the combustion is advantageously induced to occur within the chamber. In that case, combustible fuel is admitted through the first fluid inlet and air is admitted via the second fluid inlets. In some embodiments of the invention where most of the combustion occurs outside the chamber an internal flame within the chamber acts as a pilot for the main flame.

The structure of the device according to this invention provides an arrangement which will shield an internal flame from high velocity external cross winds and further ensures that the flow velocity within the chamber is kept below the values required to extinguish combustion. This is achieved by the device producing a self stabilising flow pattern which is independent of the wind direction and speed. The independence from cross-wind speed and direction requires that only one dominant flow pattern be established independent of external flow direction and speed. The geometry defined in the invention prevents the flow from "switching" between one vortex flow pattern and another as the cross-wind speed and direction changes. "Switching" is undesirable because in the brief time between the cessation of one stabilising flow pattern and the establishment of another, no flame stabilising mechanism will exist. Thus switching greatly increases the probability that the flame may be extinguished. In accordance with the preferred form of the present invention the flow of external air into the chamber and the flow of fluid out of the chamber can be controlled in order to optimise mixing between the air and the fuel and thus maintain continuous and stable combustion within the chamber.

In a preferred configuration the present invention provides a burner in which there is an ignition path between the external flame and the internal flame. The ignition path allows the external flame to ignite the internal flame, for example when the burner is first ignited, and also allows the internal flame to ignite the external flame, for example, when a high velocity gust of wind extinguishes the external flame but not the internal flame.

In the preferred burner configuration the device can advantageously be oriented such that the axis of symmetry is perpendicular to the plane of dominant external cross flow. Thus in a flare or flame exposed to atmospheric winds the best orientation of the axis of the symmetry is likely to be vertical.

In accordance with preferred features of the burner embodiment the following modifications can enhance control of flow entering the chamber and control of flow within the chamber:

(1) the flow divider may be disposed to protrude outside the chamber;
(2) the flow divider may be disposed to extend for some distance inside the chamber;
(3) the bluff body may be shaped with a curve at its outer edge to provide less resistance to the flow through the mixed fluid outlets;
(4) the chamber wall may be bell mouthed, curved, or bevelled outwardly at the second fluid inlets to provide less resistance to flow through those inlets to the chamber;
(5) an external cap may be placed outside the chamber;
(6) a flow separator may be incorporated with the flow divider to further control the flow of air in the second fluid inlets;
(7) one or more holes, slots or notches can be formed in the bluff body to control mixture fraction within the chamber;
(8) the first fluid inlet may be positioned at any suitable spacing from the bluff body.

Various embodiments of the invention will now be described, by way of example only, with reference to the accompanying drawings.

BEST MODES FOR CARRYING OUT THE INVENTION

Figure 1:
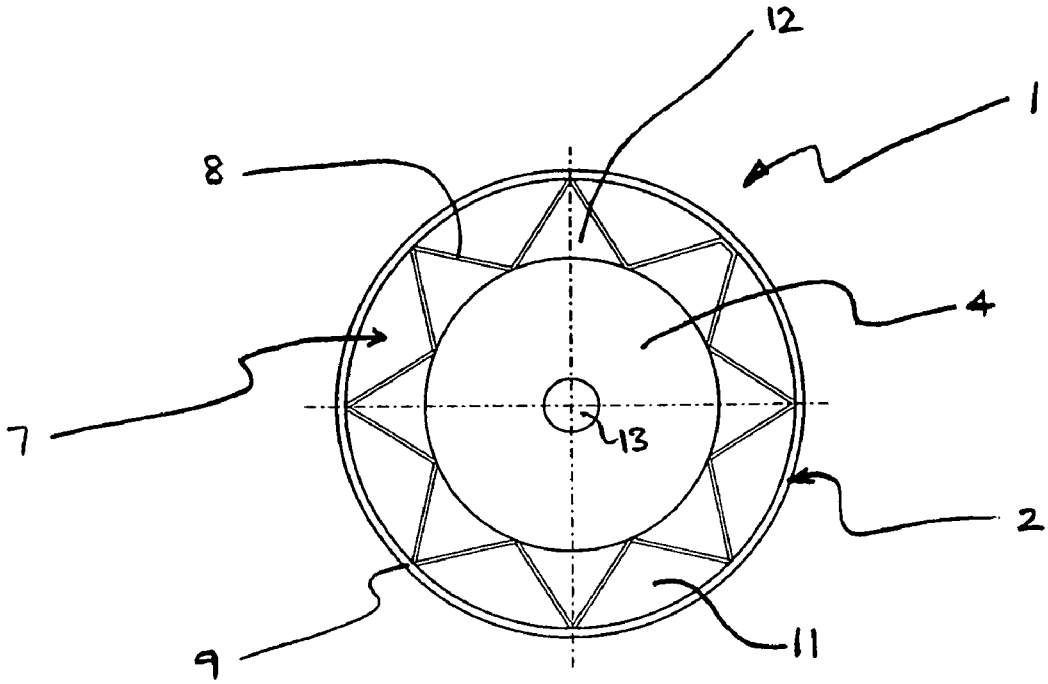
FIG. 1 is a schematic plan view of a typical configuration of the fluid mixing device for use as a burner in accordance with the invention.
Figure 2:
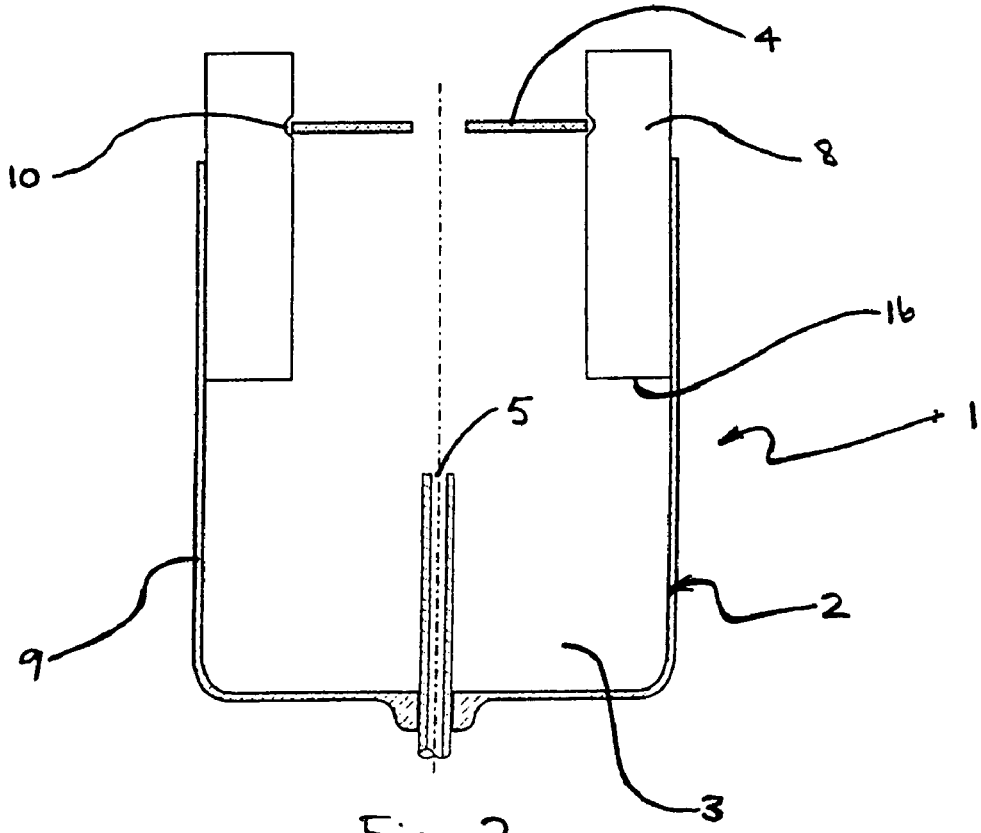
FIG. 2 is a schematic cross sectional view of the fluid mixing device shown in FIG. 1.

FIGS. 1 to 4 show a mixing device 1 according to this invention configured to operate as a burner using a mixture of 35% propane and 65% butane gaseous fuel. The fluid mixing device 1 includes a cup 2 which forms a chamber 3 closed at one end by a bluff body 4. A first fluid inlet, referred to as a jet inlet 5, extends from one end of the cup 2 and is arranged to direct a gas flow 6 toward the bluff body 4. An annular region 7 surrounding the bluff body 4 includes a corrugated flow divider 8 of triangular profile. The flow divider is supported by being fixed to the cup wall 9 and extends from within chamber 3 to beyond bluff body 4. As best seen in FIG. 2 the bluff body 4 is positioned beyond the end of cup 2 by retaining notches 10 formed in the flow divider 8. Due to its corrugated profile flow divider 8 repeatedly crosses annular region 7 between bluff body 4 and cup wall 9 which extends around the perimeter of annular region 7. In this way flow divider 8 defines a series of alternately arranged flow passages 11, 12 of approximately triangular cross-section. Flow passages 11 have the base of the triangular cross section formed by cup wall 9 and overall are closer to the cup wall 9. Flow passages 12 have the base of the triangular cross-section formed by the circumference of bluff body 4 and overall are closer to the bluff body 4. The flow passages 11 form second fluid inlets, referred to in connection with the burner application as air inlets. The flow passages 12 form mixed fluid outlets. This invention is based on generating an internal flow pattern which resists distortion by the external flow. This is accomplished by distributing the second fluid inlets 11 and mixed fluid outlets 12 in such a way that they are both subjected to nearly the same external pressure distribution. The external pressure distribution is determined primarily by the external flow, for example the wind. In an optimised arrangement the second fluid inlets 11 and mixed fluid outlets 12 are preferably at the same radial distance from the axis of the device.

Bluff body 4 includes egress means for releasing fluid from chamber 3 in the form of a centrally disposed circular aperture or hole 13. The chamber 3 has a cross sectional area that is larger than the total cross sectional area of the inlets 11. The operation of the burner is best described with reference to FIGS. 3 and 4 which schematically illustrate the expected approximate fluid flow patterns inside and near the device. The flow within the chamber 3 is characterised by a strong recirculating vortex system 14 in the region between the jet inlet 5 and bluff body 4. The vortex system 14 is generated by the jet flow 6. A weaker base vortex system 15 of opposite direction can be generated in the lower region of the chamber around or below inlet 5. The mixed fluid flows out of the chamber via outlets 12. The air inlets 11 produce an inflow to the chamber 3 immediately adjacent the mixed fluid outlet 12 flow so that both inlet 11 and outlet 12 are subjected to essentially the same aerodynamic pressure from external cross winds. In one advantageous condition, the internal flame is located adjacent to the base 16 of the flow divider 8 where external air mixes with fuel to form a combustible air/fuel mixture. The mixed fluid outlet stream provides a fuel-rich air/fuel mixture outside the combustor which burns as a partially pre-mixed external flame. The hole 13 in the bluff body 4 allows part of the air/fuel mixture to escape from the chamber. The diameter of the hole in the bluff body is a control parameter. Varying the diameter changes the proportion of fuel recirculated by the vortex system 14, and so provides a method for controlling the air/fuel ratio within the chamber.

Figure 5:
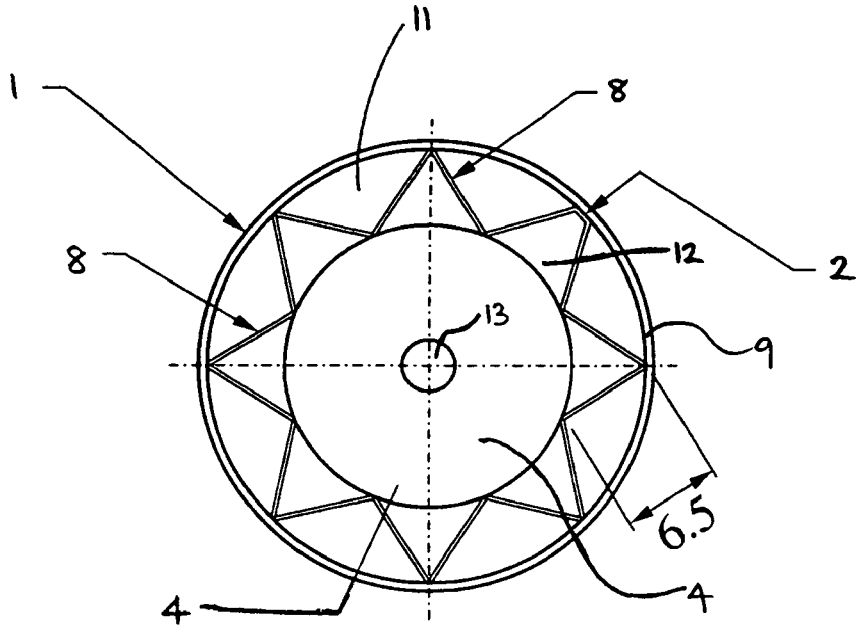
FIG. 5 is a schematic view the same as FIG. 1 including dimensions in millimeters.
Figure 6:
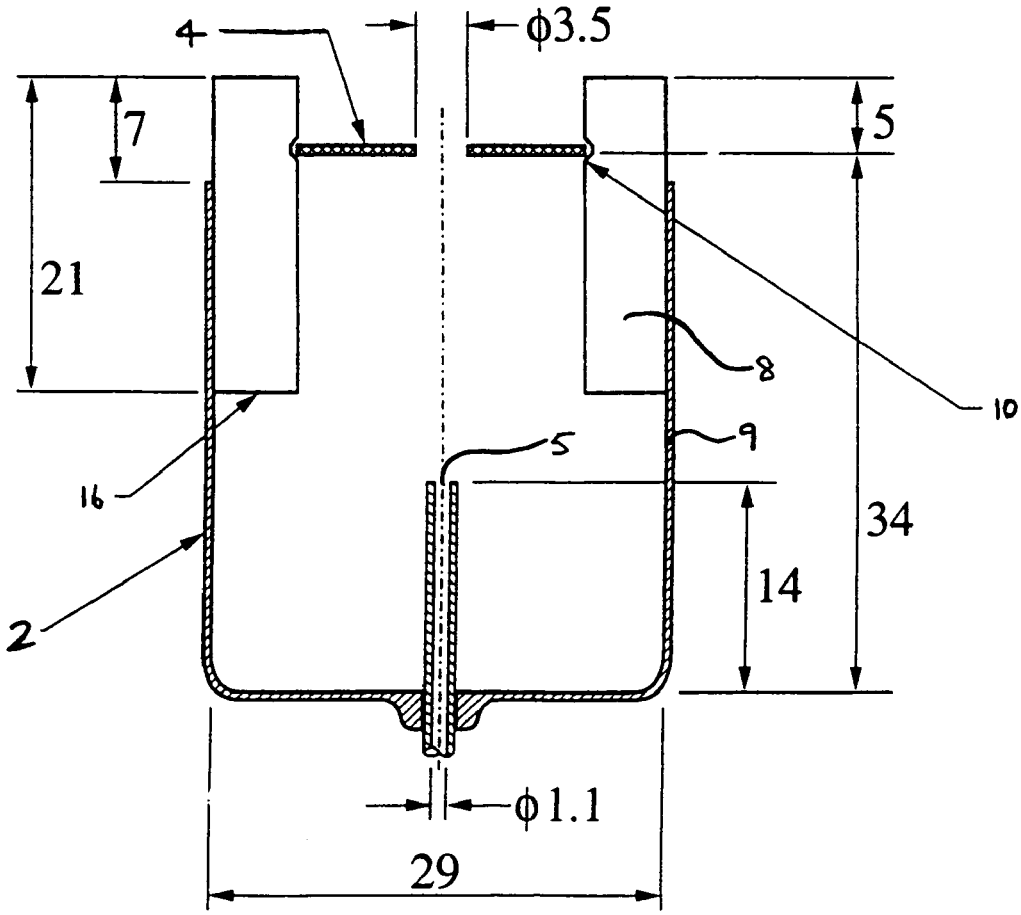
FIG. 6 is a schematic view the same as FIG. 2 including dimensions in millimeters.

FIGS. 5 and 6 correspond to FIGS. 1 and 2, but include dimensions in millimeters for a preferred burner configuration which, with a propane/butane fuel mixture, produces 3 kW of heat. The hole 13 has a diameter of 3.5 mm. This configuration produces a small internal pilot flame with the bulk of the combustion occurring outside the chamber under low wind conditions. For a 4 kW flame a 4.5 mm hole is preferred.

It will be that because of the eight identical groupings of pairs of inlets 11 and outlets 12 the device 1 possesses an eight-fold azimuthal symmetry about its longitudinal axis.

Figure 7:
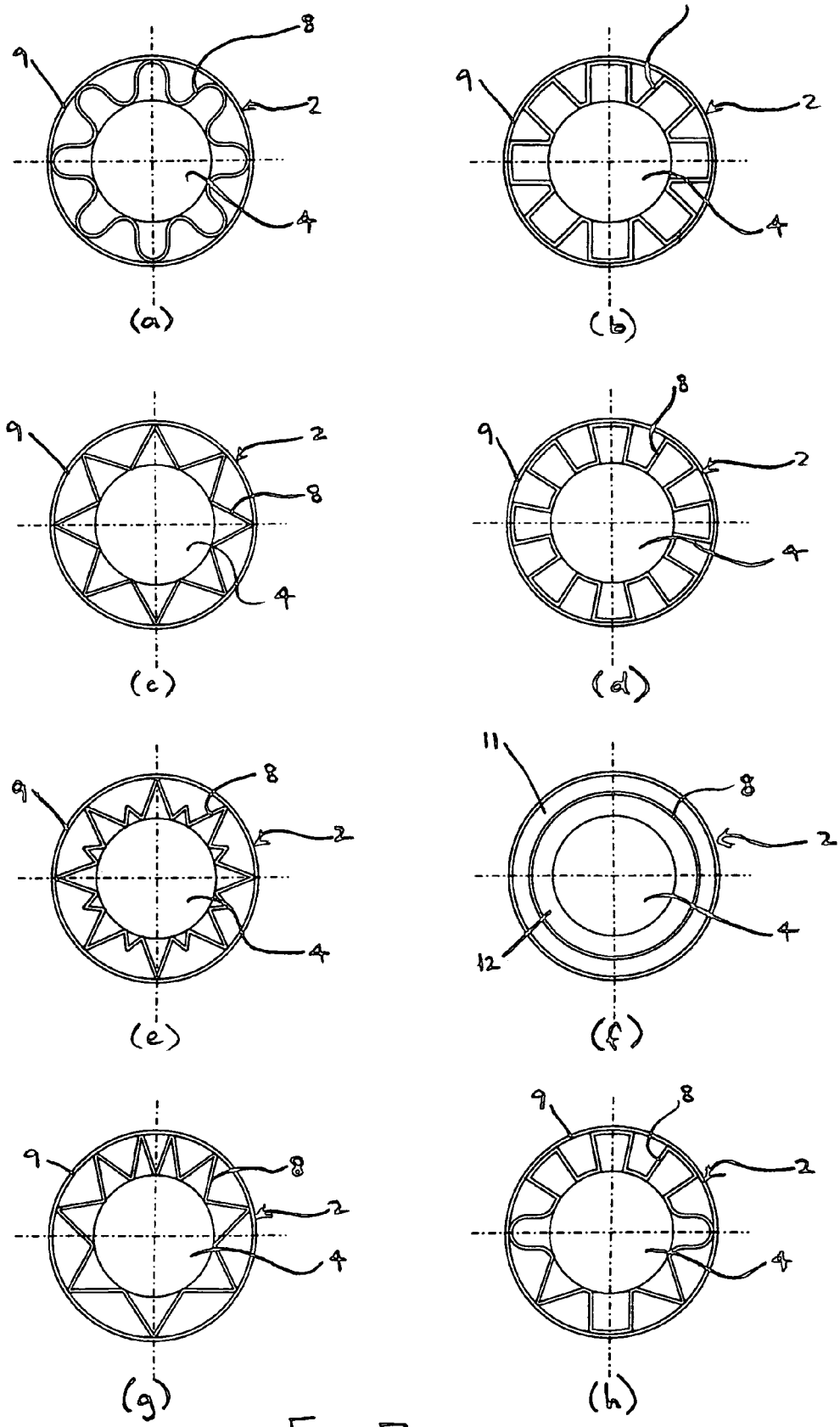
FIGS. 7(*a*) to 7(*h*) are schematic plan views showing alternative configurations of the flow divider to that shown in FIG. 1.

FIGS. 7(*a*) to 7(*h*) show a range of shapes for the flow divider 8. These can, for example, be a rounded corrugation as shown in FIG. 7(*a*), a square corrugation as shown in FIG. 7(*b*), a triangular corrugation as shown in FIG. 7(*c*) or corrugated with radial partitions as shown in FIG. 7(*d*). Alternatively a section of complex shape can be used such as shown in FIG. 7(*e*), where flow passages of different shape and size are formed. A cylindrical flow divider with annular inlet and outlet flow channels can also be used as shown in FIG. 7(*f*). FIGS. 7(*g*) and 7(*h*) show further flow divider configurations forming combinations of flow passages of differing shapes.

Figure 8:
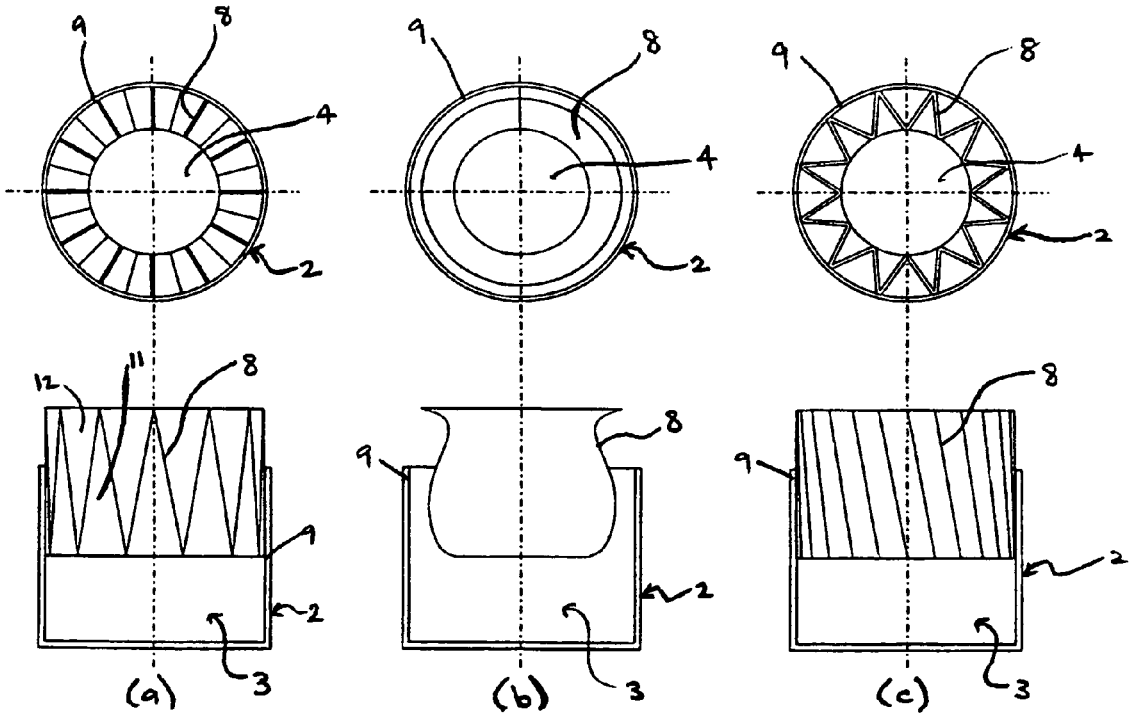
FIGS. 8(*a*) to 8(*c*) provide three alternative schematic plans and cross sectional views of the fluid mixing device highlighting alternative configurations of the flow divider.

FIG. 8 shows some modifications in accordance with which the flow divider 8 can be tapered, as in FIG. 8(*a*), twisted as in FIG. 8(*c*) or otherwise varied in shape as shown in FIG. 8(*b*).

Figure 3:
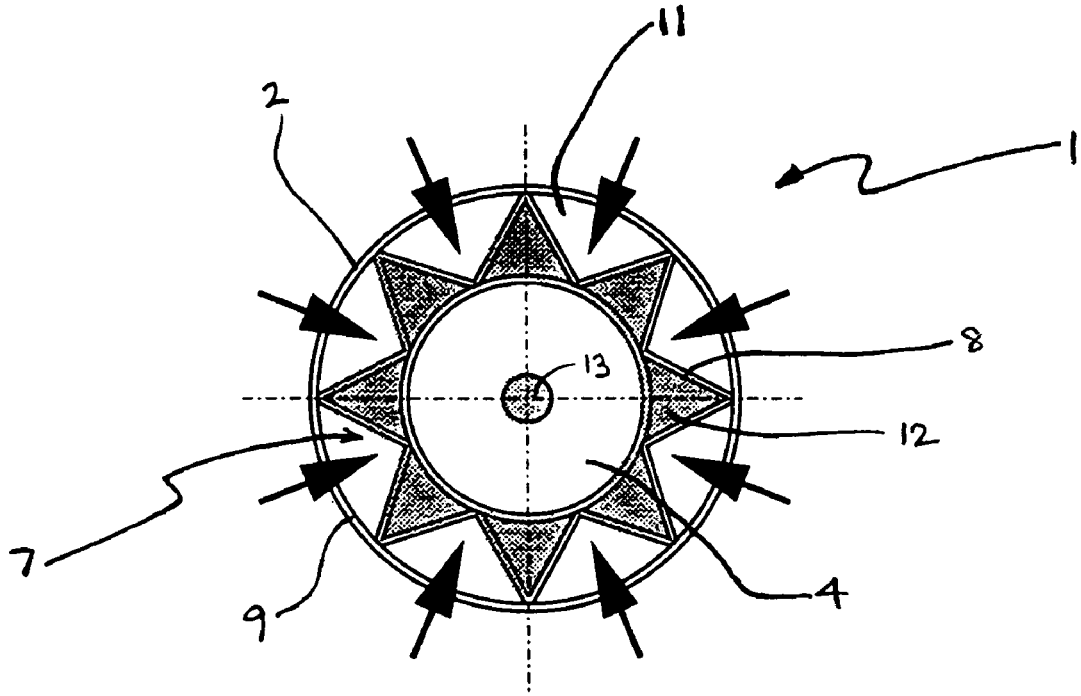
FIG. 3 shows a schematic plan similar to FIG. 1 illustrating possible flow patterns within the fluid mixing device according to this invention.
Figure 4:
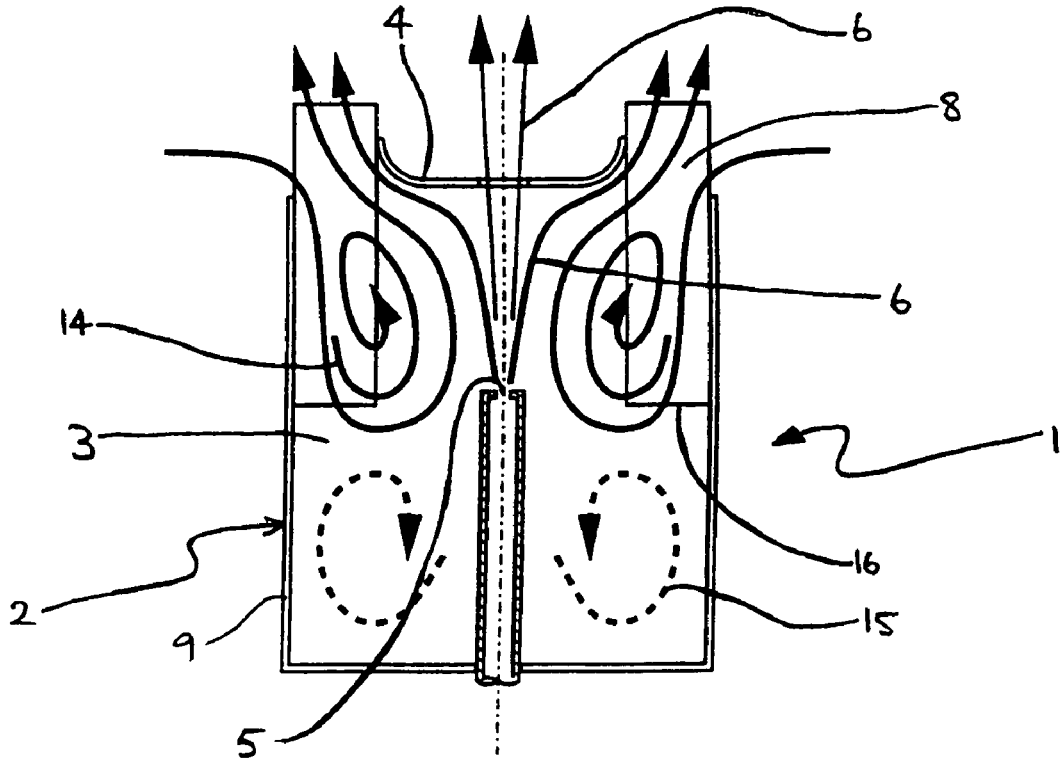
FIG. 4 shows a cross section similar to FIG. 2 illustrating possible flow patterns within the fluid mixing device according to this invention.

As described above with respect to exemplary embodiments shown by way of example in FIGS. 1-4, a mixing device 1 includes a cup 2 which forms a chamber 3. The mixing device 1 is defined by a bluff body 4 at one end of the chamber 3. The bluff body 4 substantially encloses the chamber at one end. A first fluid inlet 5 is disposed in the chamber 3 opposite from the bluff body 4. As shown in FIG. 3, a flow divider 8 extends from within the cup 2, which forms the chamber 31 to outside of the cup 2. The mixing device 1 further includes at least one second fluid inlet 11 to the chamber 3. The second fluid inlet(s) 11 are defined by the flow divider 8 in a region substantially surrounding the bluff body 4. The mixing device 1 further includes at least one mixed fluid outlet 12 from the chamber 3 defined by the flow divider 8 in a region substantially surrounding the bluff body 4.

Figure 9:
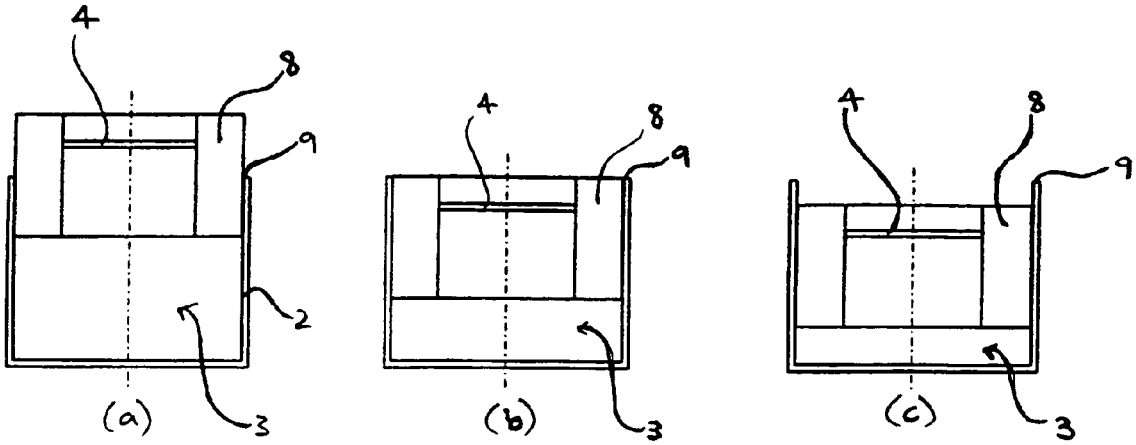
FIGS. 9(*a*) to 9(*c*) shows three cross sectional views of the fluid mixing device according to the invention providing alternative locations of the flow divider relative to the chamber cup.

FIGS. 9(*a*) to 9(*c*) show various positions that can be used for the flow divider 8. In some applications the flow divider 8 protrudes beyond the rim of wall 9 of the cup 2 and/or bluff body 4 as shown in FIG. 9(*a*). In other applications the flow divider may be flush with the rim of wall 9 of cup 2 as shown in FIG. 9(*b*) or recessed below the rim of wall 9 as shown in FIG. 9(*c*). Changing this parameter alters the response of the average internal air/fuel ratio and the internal flow field to the strength of the external cross flow.

Figure 10:
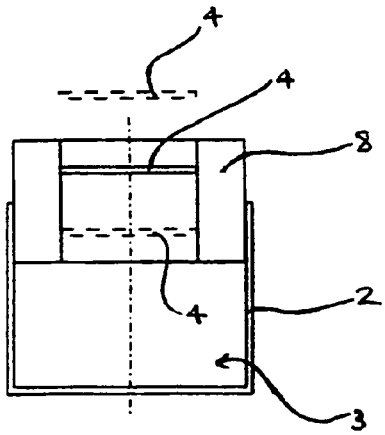
FIG. 10 is a schematic cross sectional view of a fluid flow device according to the invention showing possible bluff body locations.

FIG. 10 shows in dotted outline two alternatives for the position of the bluff body 4 with respect to the cup 2 and flow divider 8. The bluff body 4 may be located according to the particular application within the flow divider 8 or within one bluff body diameter external to the flow divider 8.

Figure 11:
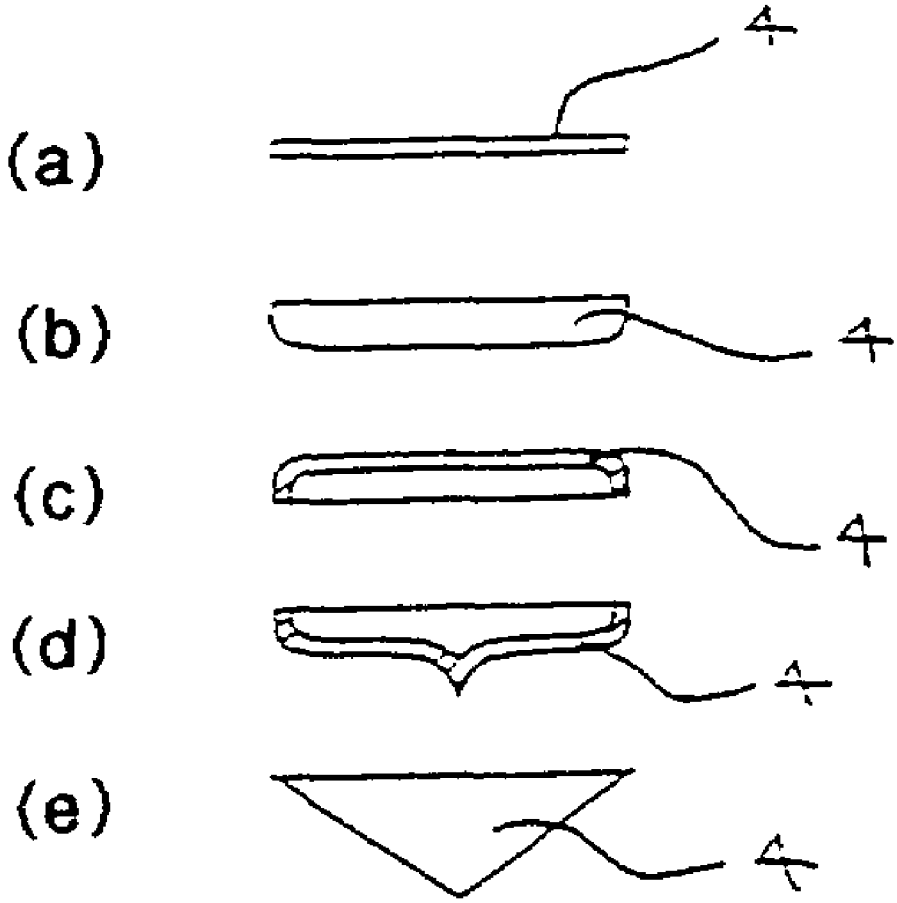
FIG. 11 shows schematic side views (some sectioned) of five alternate bluff body shapes for use in the fluid flow device of this invention.

FIG. 11 shows side views some of which are sectioned views of a range of shapes that can be used for the bluff body 4. The bluff body shape can be (a) flat, (b) rounded, (c) cupped, (d) formed by a complex combination, or (e) wedge shaped, or any combination of shapes.

Figure 12:
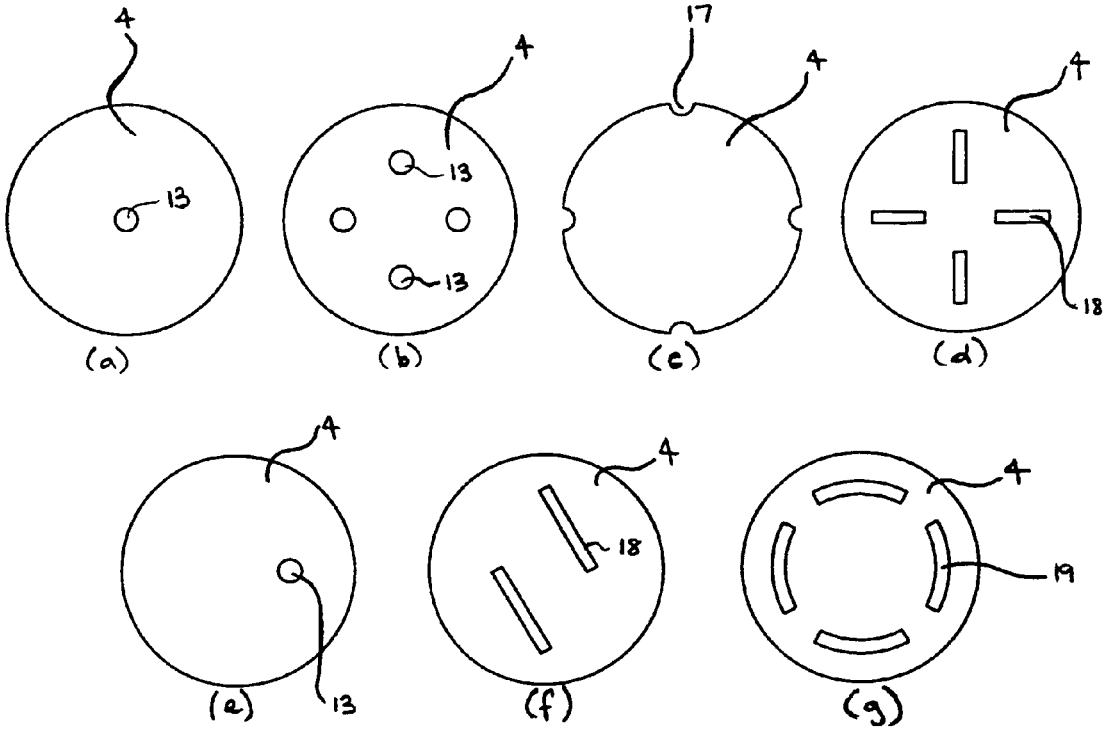
FIGS. 12(*a*) to 12(*g*) show schematic plan views of various bluff body configurations for use in the fluid flow device of this invention.

FIGS. 12(*a*) to 12(*g*) show modified configurations for the bluff body 4. The purpose of the bluff body is to deflect a proportion of the jet inlet flow radially outwards from the axis of the device, and so assist with forming the main internal vortex system which provides the mechanism for the flow recirculation and stabilising the flame. The proportion of fuel which escapes from the chamber without taking part in the stabilising mechanism is determined by the distribution of holes, slots and notches in the bluff body.

As can be seen in the views of, for example, FIG. 2, the chamber 3 is substantially free of fluid flow obstructions extending in a direction transverse to the jet fluid flow in a region between the second fluid inlet(s) 11/mixed fluid outlet(s) 12 and the first fluid inlet 5.

As shown in FIG. 12(*a*), the bluff body 4 can have a single central hole 13. Alternatively as shown in FIG. 12(*b*) four equidistant holes 13 can be found in the bluff body 4. In another arrangement shown in FIG. 12(*c*) four equally spaced semi-circular holes 17 can be formed in the rim of bluff body 4. FIG. 12(*d*) shows an arrangement in which four radially extending slots 18 are found in the bluff body. FIG. 12(*e*) shows a single hole 13 offset from the centre of bluff body 4. FIG. 12(*f*) shows two parallel slots 18 in the bluff body 4 each offset from the centre. FIG. 12(*g*) shows arcuate slots 19 in bluff body 4 arranged around a circle concentric with the bluff body 4. The bluff body may include any combination of the arrangements shown in FIGS. 12(*a*) to 12(*g*). The bluff body can also be made from or include porous material with uniform porosity.

Figure 13:
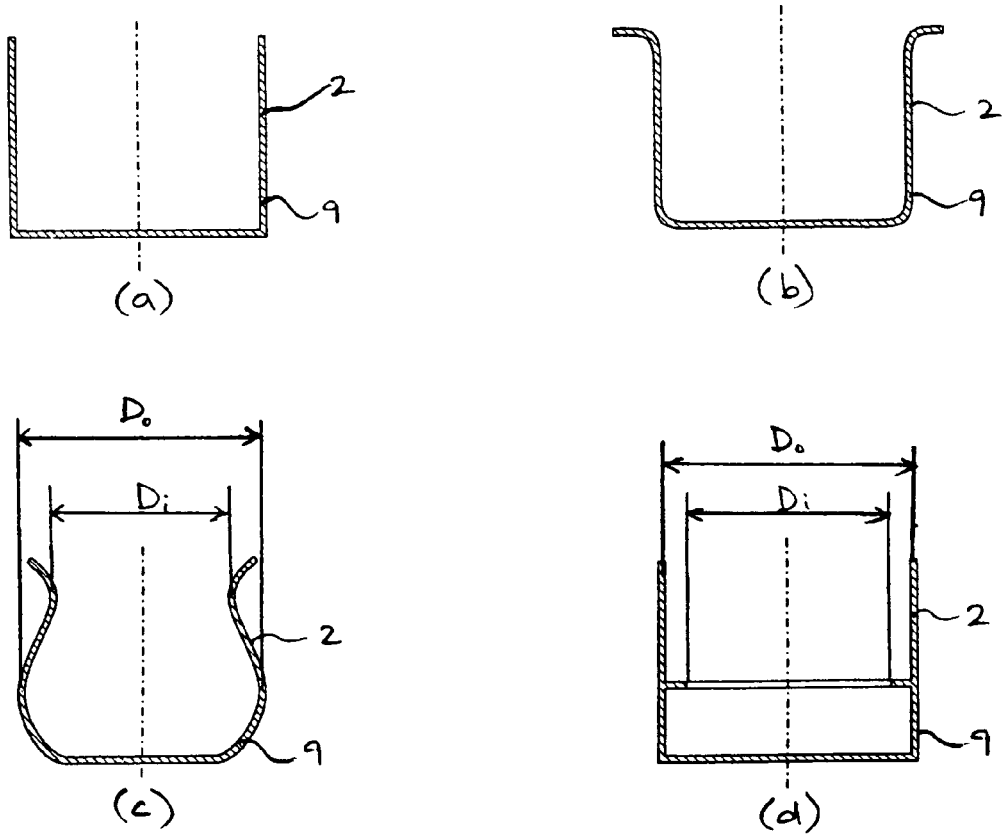
FIGS. 13(*a*) to 13(*d*) show some of the possible variations in cross sectional shape of the chamber forming part of the fluid mixing device of this invention.

FIGS. 13(*a*) to 13(*d*) show some variations of the cross sectional shape of the chamber formed by cup 2. FIG. 13(*a*) shows a cup chamber generally as described above. The chamber can have rounded corners as shown in FIG. 13(*b*) or curved walls as shown in FIG. 13(*c*) such that the ratio of mean throat diameter Di to maximum mean diameter Do will not be less than 0.5 or greater than 2.0. FIG. 13(*d*) shows a chamber formed with an internal annular ring.

Figure 14:
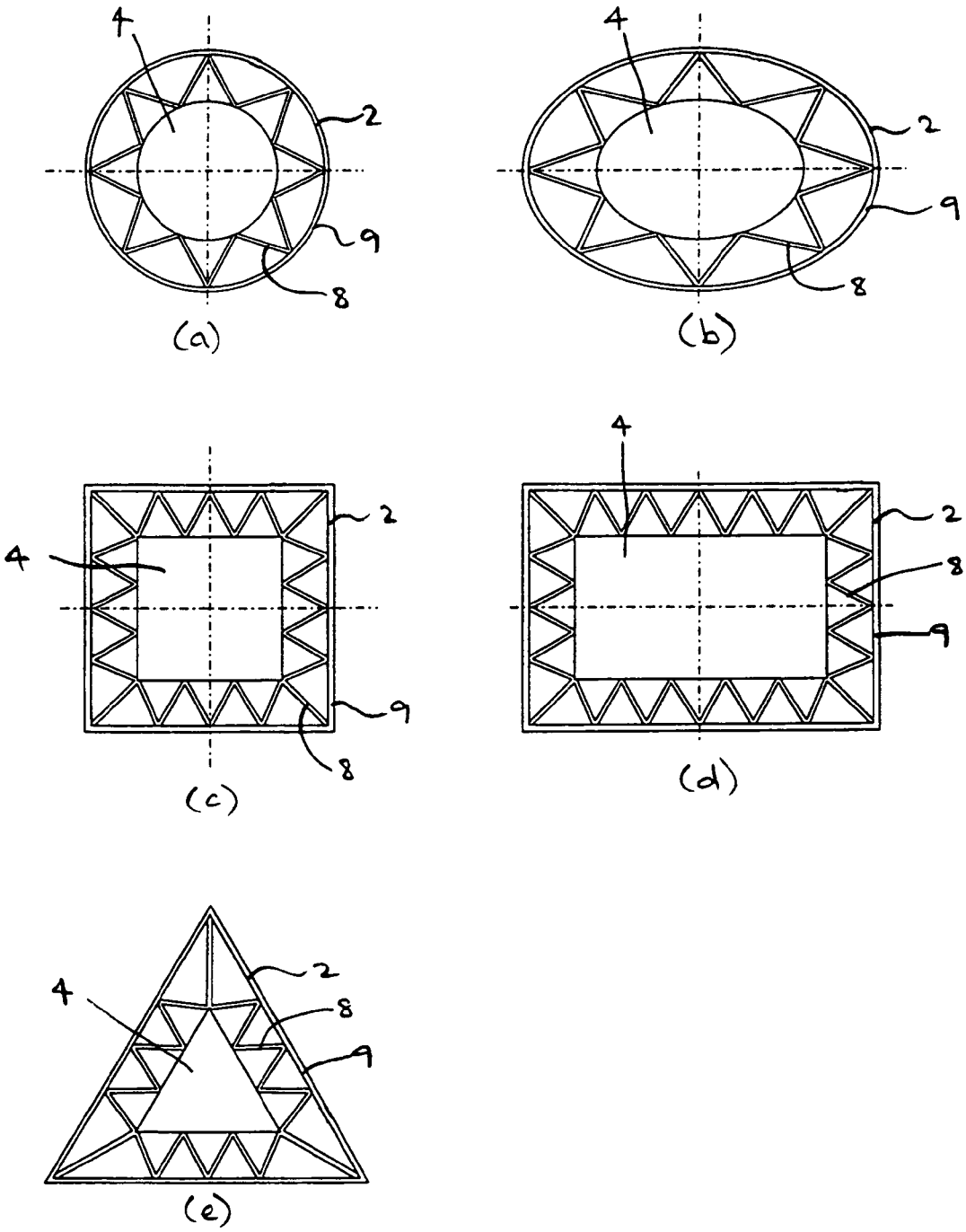
FIGS. 14(*a*) to 14(*e*) is a series of plan views of fluid mixing devices according to this invention and showing some of the possible chamber shapes.

FIGS. 14(*a*) to 14(*e*) show schematic plan views of various possible shapes of the chamber 3 formed by cup 2. The chamber may be of any cross sectional shape including, but not limited to circular, elliptical, square, rectangular, triangular or any approximation thereof.

Figure 15:
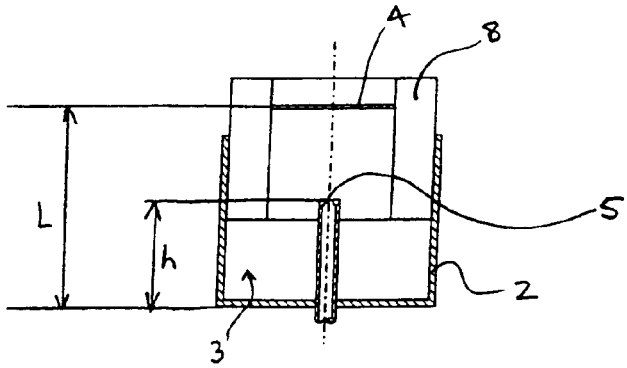
FIG. 15 is a schematic cross section of a fluid mixing device according to this invention showing the location of a first fluid inlet.

FIG. 15 schematically illustrates the location of the jet inlet 5. The inlet may be positioned at any appropriate height h from the base of the chamber that satisfies the relationship $0<h/L<1$ where L is the distance from the lower or opposite end of cup 2 to the bluff body. For the embodiment shown in FIGS. 1 to 6 the ration h/L is about 0.4. The inlet flow may consist of any number of fluid streams with a similar orientation and location. There may be two or more coaxial fluid streams. Each fluid stream may have a different chemical composition and/or thermodynamic state.

Figure 16:
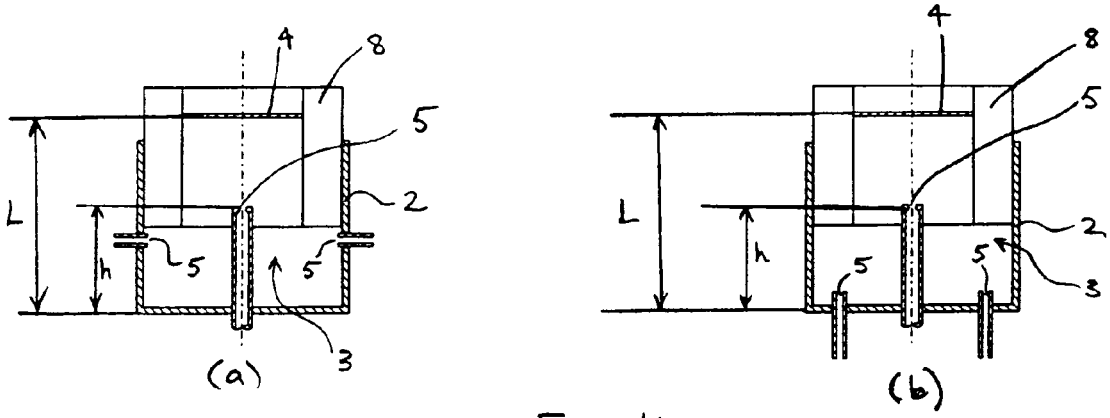
FIGS. 16(*a*) and 16(*b*) are views similar to FIG. 15 showing the incorporation of additional inlets to the fluid flow device.

FIGS. 16(*a*) and 16(*b*) show a variation incorporating additional inlets 5. These may be in the sides of the cup 2 as shown in FIG. 16(*a*) or in the base of the cup 2 as shown in FIG. 16(*b*) or in any combination of these two locations.

Figure 17:
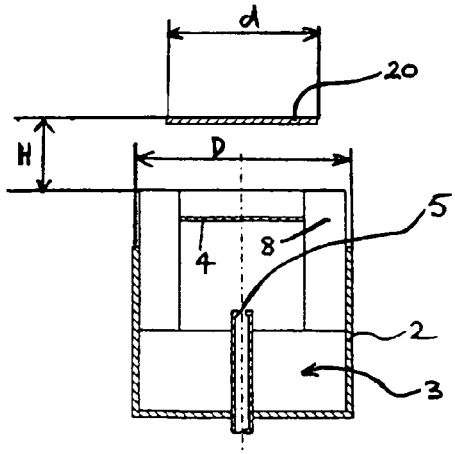
FIG. 17 is a schematic cross section of a fluid flow device according to this invention showing the addition of an external cap.

FIG. 17 illustrates an external cap or plate 20 that may be located adjacent the flow outlet. The cup can be supported in position by any suitable bracket or support (not shown). The preferred diameter "d" of the cap 20, and the preferred distance H from the top of the flow divider to the cap and the diameter of the cup "D" satisfy the following relationships:

$$0.1 \leqq d/D \leqq 2.0$$

$$0.0 \leqq H/D \leqq 2.0$$

Figure 18:
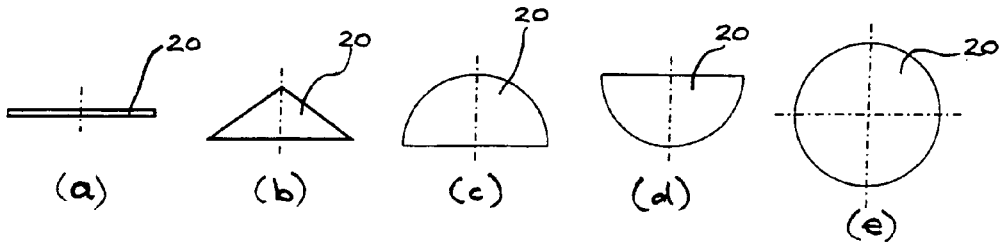
FIGS. 18(*a*) to 18(*e*) schematically illustrate alternative cross sectional shapes for the external cap shown in FIG. 17.

FIGS. 18(*a*) to 18(*d*) show a variety of cross sectional shapes that may be used for the external cap 17. The cap 20 may be of any suitable curved or flat shape.

Figure 19:
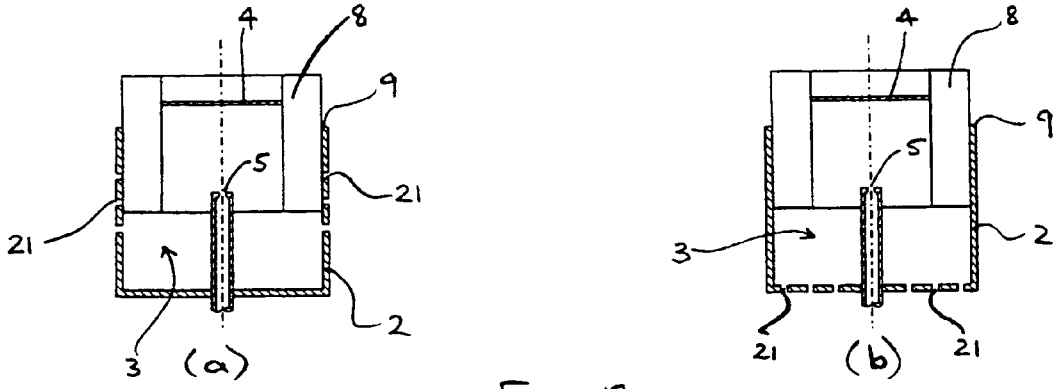
FIGS. 19(*a*) and 19(*b*) are schematic cross sections of a fluid flow device according to this invention showing alternative configurations of additional inlets to the chamber.

FIG. 19 shows a modification to include additional air inlets 21. In FIG. 19(*a*) the additional air inlets 21 are shown in the wall 9 of the cup 2 whilst in FIG. 19(*b*) they are shown in the base of the cup 2. Any combination of inlets in both the base and the sides is also possible.

An important feature of the invention is its insensitivity and adaptability to variations in the external flow. Several critical dimensions of the device have been identified. Some embodiments of the invention may therefore include sensors, data processors and actuator mechanisms which can change the geometry of the device so that it can better adapt to the external flow conditions, fuel type, required flame type, industrial process requirements or pollution standards, for example. Examples of parameters which may be dynamically varied in a single embodiment of the device are:

1. distance of the jet inlet 5 from the base of the cup;
2. the orifice size and shape of the jet inlet 5;
3. the location of the divider 8, as shown in FIGS. 9(*a*) to 9(*c*);
4. the shape, location, number and size of the external air inlets 11;
5. the shape, location, number and size of the mixed fluid outlets 12;
6. the shape, location, number and size of additional inlets 21;
7. the size and shape of the chamber 3;
8. the number, size and location of holes in the bluff body, or porosity of the bluff body.

The foregoing describes only some embodiments of this invention and modifications can be made without departing from the scope of the invention.

The invention claimed is:

1. A fluid mixing device, comprising:

a cup defining a chamber;

a bluff body extending across and substantially closing one end of the chamber;

a first fluid inlet disposed at an opposite end of said chamber from said bluff body and arranged to direct a jet fluid flow into the chamber toward said bluff body;

a flow divider disposed in a region substantially surrounding said bluff body and extending from within said chamber to outside of said chamber;

at least one second fluid inlet to said chamber defined by said flow divider in said region substantially surrounding said bluff body and arranged to direct a fluid flow opposing the jet fluid flow into the chamber, and at least one mixed fluid outlet from said chamber defined by said flow divider in said region substantially surrounding said bluff body, wherein said bluff body includes an egress for releasing fluid from said chamber.

2. A fluid mixing device as claimed in claim 1, wherein said egress includes material porous to said fluids forming at least part of said bluff body.

3. A fluid mixing device as claimed in claim 1, wherein said egress includes one or more apertures extending through said bluff body.

4. A fluid mixing device as claimed in claim 3, wherein said bluff body includes a centrally disposed aperture.

5. A fluid mixing device as claimed in claim 4, wherein said first fluid inlet is directed substantially toward said centrally disposed aperture.

6. A fluid mixing device as claimed in claim 5, wherein said aperture has a circular cross section.

7. A fluid mixing device, comprising:

a cup defining a chamber;

a bluff body extending across and substantially closing one end of the chamber;

a first fluid inlet disposed at an opposite end of said chamber from said bluff body and arranged to direct a jet fluid flow into the chamber toward said bluff body;

a flow divider disposed in a region substantially surrounding said bluff body and extending from within said chamber to outside of said chamber;

at least one second fluid inlet to said chamber defined by said flow divider in said region substantially surrounding said bluff body and arranged to direct a fluid flow opposing the jet fluid flow into the chamber, and at least one mixed fluid outlet from said chamber defined by said flow divider in said region substantially surrounding said bluff body, wherein said flow divider has a corrugated profile so as to repeatedly cross said region surrounding the bluff body.

8. A fluid mixing device as claimed in claim 7, wherein said chamber includes an outer wall extending substantially around the perimeter of said region surrounding the bluff body.

9. A fluid mixing device as claimed in claim 8, wherein said corrugated profile alternately contacts the bluff body and said outer wall.

10. A fluid mixing device as claimed in claim 9, wherein the geometric centers of the cross-section of each of the flow channels defined by said corrugated profile are alternately substantially closer to the outer wall and substantially closer to the bluff body.

11. A fluid mixing device as claimed in claim 10, wherein the flow channels having cross-sections with geometric centers substantially closer to the outer wall form said second fluid inlets and the flow channels having cross-sections with geometric centers substantially closer to the bluff body form said mixed fluid outlets.

12. A fluid mixing device as claimed in claim 7, wherein said corrugated profile is of triangular form so that said flow channels are generally triangular in cross section.

13. A fluid mixing device as claimed in claim 12, wherein at least alternate flow channels have substantially the same cross section size.

14. A fluid mixing device as claimed in claim 13, wherein said corrugated profile defines eight flow channels forming second fluid inlets each alternately interposed with eight flow channels forming mixed fluid outlets.

15. A fluid mixing device as claimed in claim 14, wherein the mixing device has eight-fold azimuthal symmetry about a longitudinal axis.

* * * * *